US006422216B1

(12) United States Patent
Lyko et al.

(10) Patent No.: US 6,422,216 B1
(45) Date of Patent: Jul. 23, 2002

(54) EXHAUST GAS RECIRCULATION VALVE

(75) Inventors: Bohdan Michael Lyko, Webster; Dwight Orman Palmer, Rochester, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/702,364

(22) Filed: Oct. 31, 2000

(51) Int. Cl.[7] ..... F02M 25/07

(52) U.S. Cl. ..... 123/568.11; 123/568.23; 123/568.26

(58) Field of Search ..... 123/568.11, 568.26, 123/568.23

(56) References Cited

U.S. PATENT DOCUMENTS

| | | | | |
|---|---|---|---|---|
| 4,175,522 A | | 11/1979 | Kawamura et al. | 123/275 |
| 4,805,582 A | | 2/1989 | Braun et al. | 123/568.26 |
| 4,961,413 A | | 10/1990 | Grey et al. | 123/568.26 |
| 5,020,505 A | | 6/1991 | Grey et al. | 123/568.26 |
| 5,685,519 A | | 11/1997 | Bircann et al. | 251/129.15 |
| 5,779,220 A | | 7/1998 | Nehl et al. | 251/129.15 |
| 5,809,964 A | | 9/1998 | Meistrick et al. | 123/321 |
| 5,878,779 A | | 3/1999 | Bircann et al. | 137/554 |
| 6,012,424 A | | 1/2000 | Meistrick | 123/321 |
| 6,050,248 A | * | 4/2000 | Arulraja et al. | 123/568.11 |

* cited by examiner

*Primary Examiner*—Andrew M. Dolinar
*Assistant Examiner*—Arnold Castro
(74) *Attorney, Agent, or Firm*—John VanOphem

(57) ABSTRACT

A hydraulically actuated exhaust gas recirculation valve assembly for metering exhaust gas to the intake of an internal combustion engine. The exhaust gas recirculation valve assembly includes a base having an internal cavity with a control portion and a flow-through portion permitting flow-through of exhaust gas. The base has a hydraulic control port in fluid communication with the control portion of the cavity, the control port having an inlet. A valve body is rotationally mounted within the base, the valve body including a hydraulic control spool disposed within the control portion of the internal cavity. The hydraulic control spool generates a rotational force in response to a hydraulic pressure applied to the control port. The valve body further includes an exhaust gas control spool positioned in the flow-through portion of the internal cavity and connected to the hydraulic control spool and rotated therewith to selectively control flow of exhaust gas through the flow-through portion of the internal cavity.

23 Claims, 5 Drawing Sheets

EXHAUST GAS RECIRCULATION VALVE

TECHNICAL FIELD

The present invention relates to an exhaust gas recirculation valve for metering exhaust gas flow to the intake of an internal combustion engine.

BACKGROUND OF THE INVENTION

Exhaust gas recirculation (EGR) valves are used to control exhaust gas recirculation in internal combustion engines. Existing EGR valve assemblies include a valve positioned by an electrical solenoid to meter the exhaust gas which passes through the EGR valve assembly. The solenoid retracts the valve from a seat to increase recirculation of exhaust gas, and advances the valve toward the seat to reduce recirculation of gas. The seat is incorporated in a base assembly that mounts the valve on the engine manifold.

Existing EGR valves, such as set forth in U.S. Pat. No. 5,020,505 issued Jun. 4, 1991 to Grey et al. include a magnetic solenoid actuator that moves a valve member relative to a valve seat to regulate the flow of exhaust gas therethrough. During operation of EGR valves, the valve member may become encrusted with carbon or other exhaust material, interfering with the operation of the EGR valve. Build up of exhaust matter may lead to leakage of exhaust gas or otherwise interfere with the movement of the valve member, thus making it difficult to meet ever-tightening emission regulations for internal combustion engines, particularly after the engine and EGR valve have been used for a period of time.

SUMMARY OF THE INVENTION

One aspect of the present invention is a hydraulically actuated exhaust gas recirculation valve assembly for metering exhaust gas to the intake of an internal combustion engine. The exhaust gas recirculation valve assembly includes a base having an internal cavity with a control portion and a flow-through portion permitting flow-through of exhaust gas. The base has a hydraulic control port in fluid communication with the control portion of the cavity, and the control port has an inlet. A valve body is rotationally mounted within the base. The valve body includes a hydraulic control spool disposed within the control portion of the internal cavity. The hydraulic control spool generates a rotational force in response to a hydraulic pressure applied to the control port. The valve body further includes an exhaust gas control spool positioned in the flow-through portion of the internal cavity and connected to the hydraulic control spool and rotated therewith to selectively control flow of exhaust gas through the flow-through portion of the internal cavity.

Another aspect of the present invention is an internal combustion engine including a hydraulically actuated valve assembly for metering exhaust gas to the intake valve of the internal combustion engine. The valve assembly includes a housing having an exhaust gas inlet port operably connected to the exhaust of the internal combustion engine. An exhaust gas outlet port is operably connected to the intake of the internal combustion engine. A valve body is movably mounted within the housing and selectively meters the flow of exhaust gas between the exhaust gas inlet port and the exhaust gas outlet port upon movement of a valve body within the housing. The valve body is operably connected to a source of pressurized hydraulic fluid and configured to move for metering of exhaust gas flow upon application of hydraulic pressure to the valve body.

Another aspect of the present invention is a hydraulically actuated exhaust gas recirculation valve assembly for metering exhaust gas to the intake of an internal combustion engine. The valve assembly includes a housing having an internal cavity defining a generally cylindrical sidewall surface and having an exhaust gas inlet port in fluid communication with the internal cavity and adapted to be connected to the exhaust of an internal combustion engine. The housing further includes an exhaust gas outlet port in fluid communication with the internal cavity and adapted to be connected to the intake of an internal combustion engine. A valve body is rotatably mounted within the internal cavity and selectively meters exhaust gas flow through the housing. The valve body includes a sharpened knife edge disposed adjacent the sidewall surface, such that the knife edge removes exhaust gas deposits from the sidewall surface upon rotation of the valve body.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
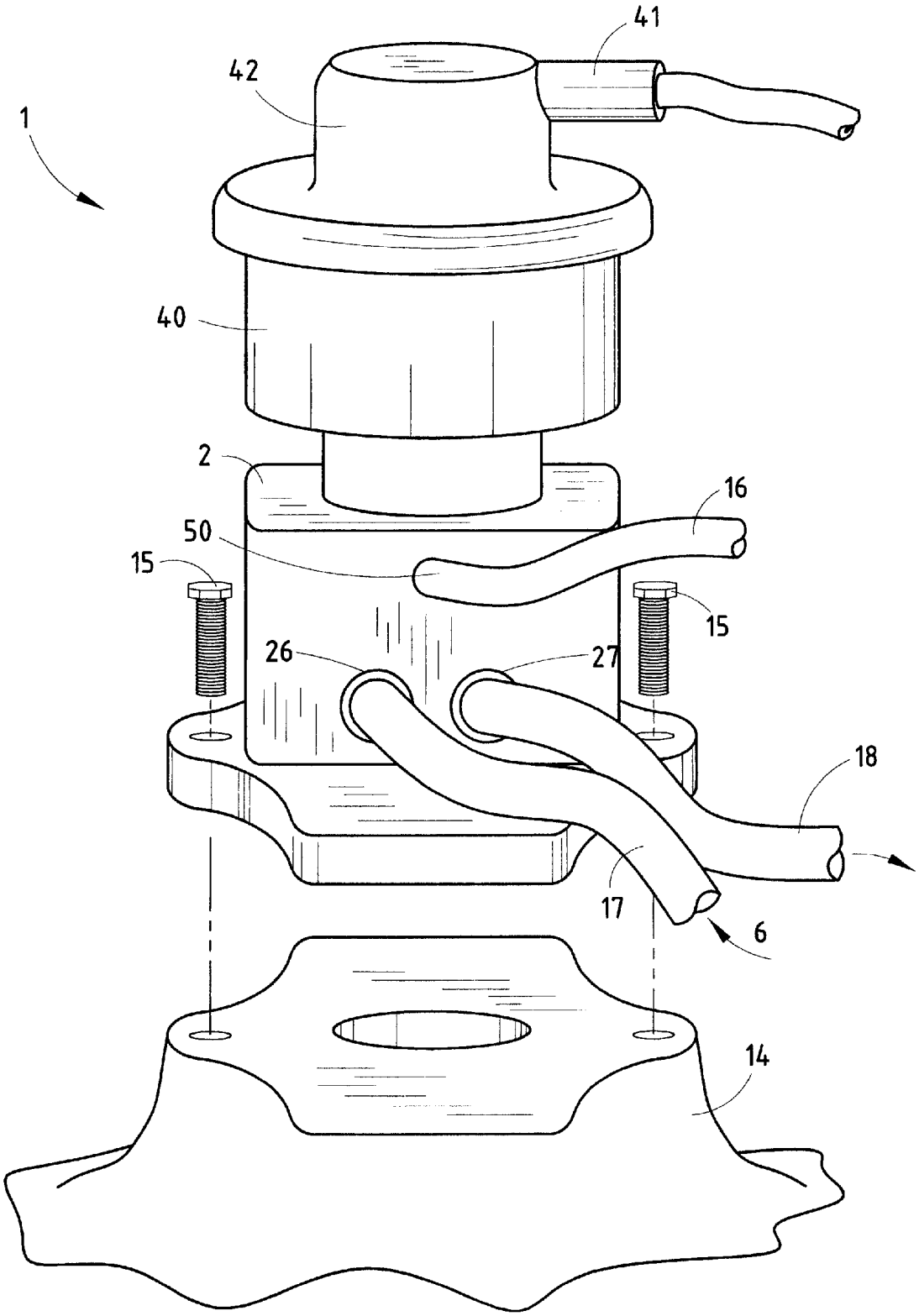
FIG. 1 is a partially exploded, partially fragmentary perspective view of a hydraulically controlled EGR valve according to the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
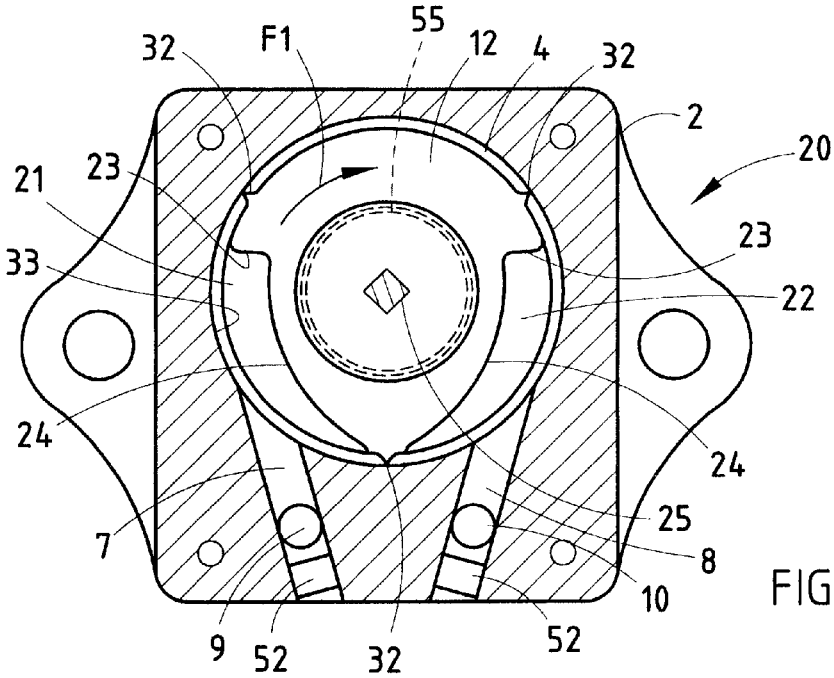
FIG. 4 is a cross-sectional view of the EGR valve of FIG. 2 showing the hydraulic control spool taken along the line IV—IV, FIG. 2.
Figure 5:
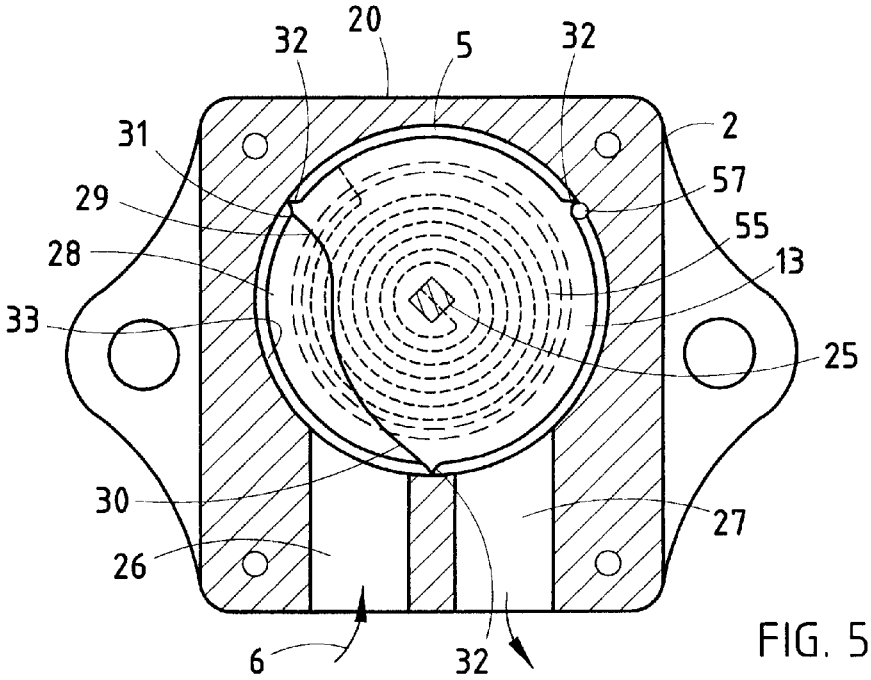
FIG. 5 is a cross-sectional view of the EGR valve of FIG. 2 showing the exhaust gas control spool taken along the line V—V, FIG. 2.
Figure 6:
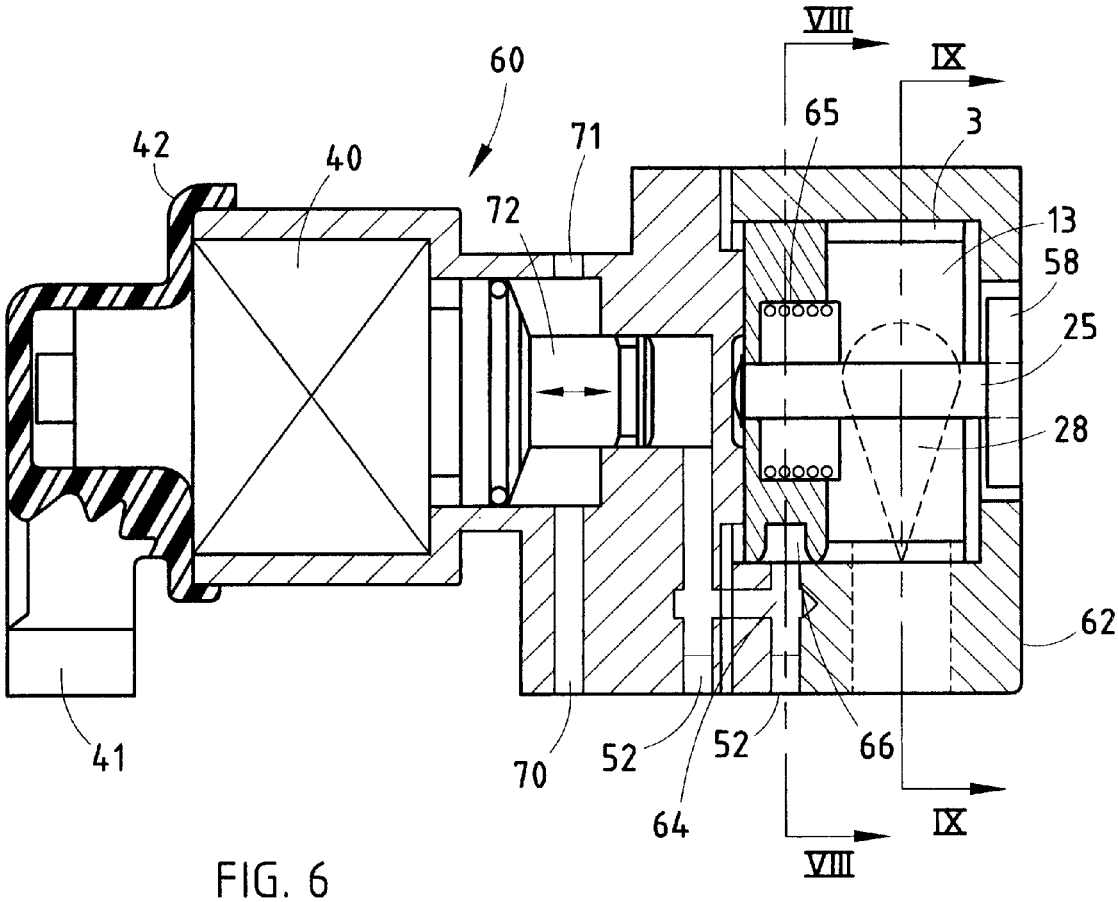
FIG. 6 is a cross-sectional view of a second embodiment of the EGR valve of FIG. 1 wherein the valve body is hydraulically powered in a first rotational direction, and utilizes a spring to bias the valve body in a second rotational direction.
Figure 7:
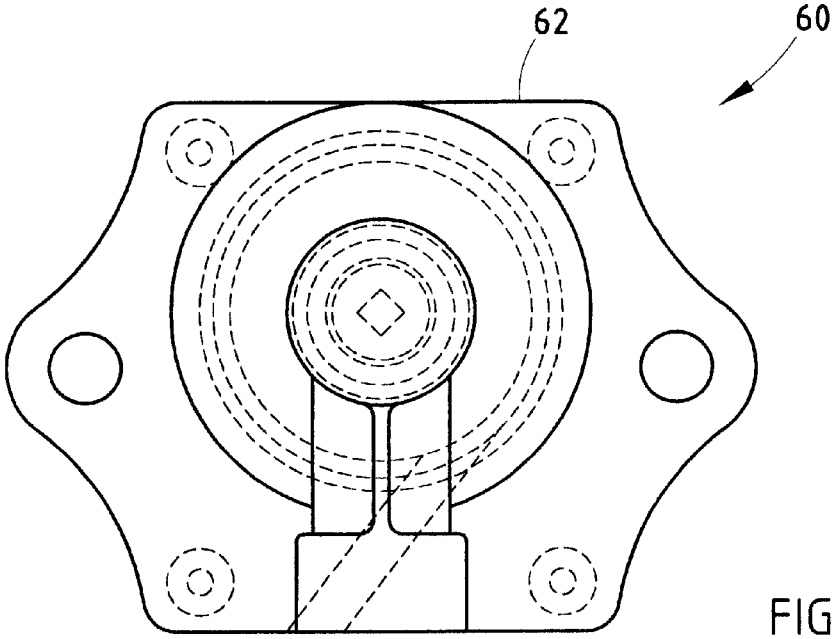
FIG. 7 is a side elevational view of the EGR valve of FIG. 6.
Figure 8:
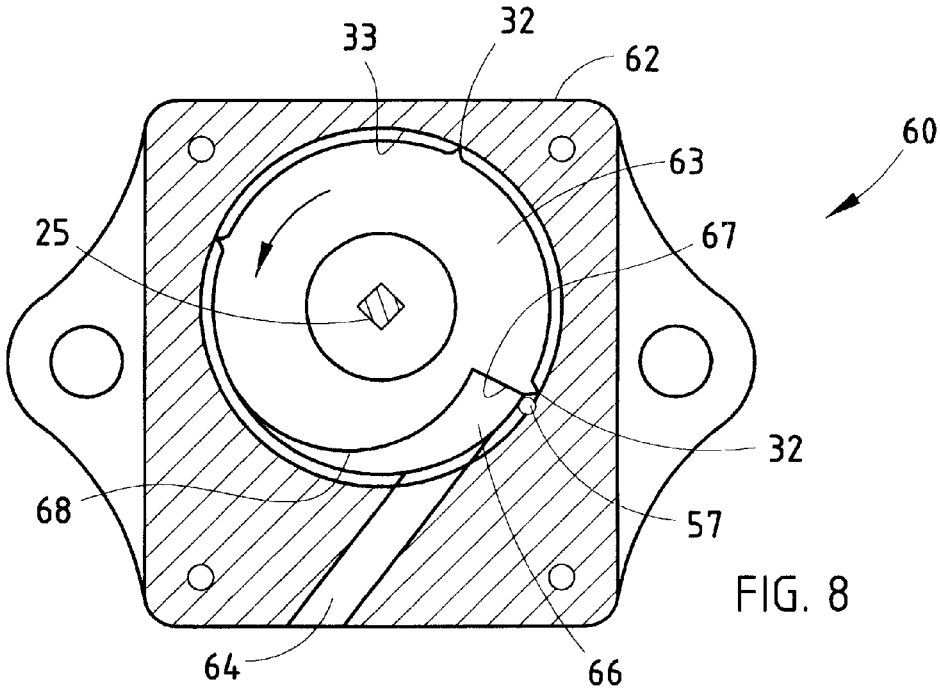
FIG. 8 is a cross-sectional view of the EGR valve of FIG. 6 showing the hydraulic control spool taken along the line VIII—VIII, FIG. 6.
Figure 9:
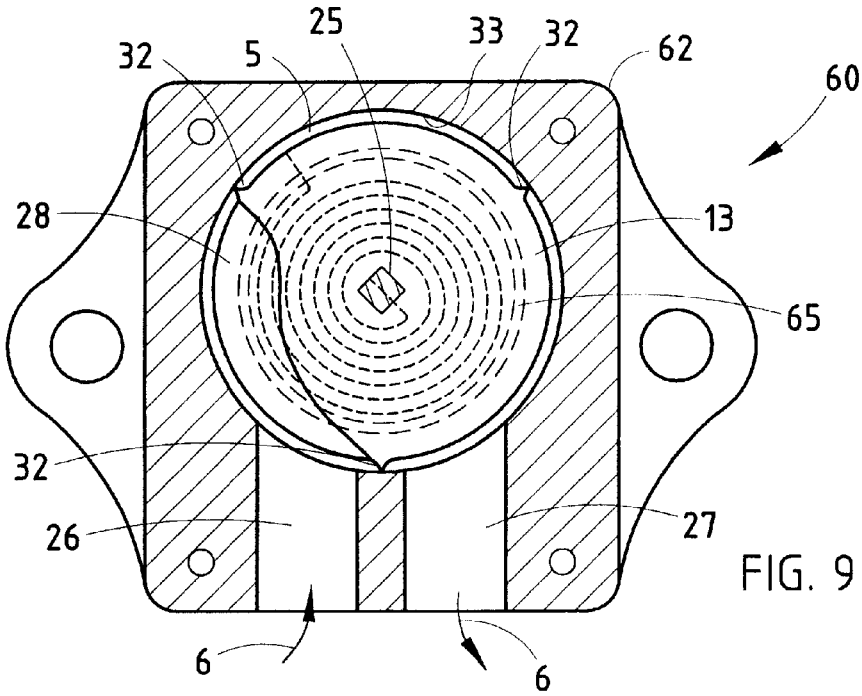
FIG. 9 is a cross-sectional view of the EGR valve of FIG. 6 showing the exhaust gas control spool, taken along the line IX—IX, FIG. 6.

The reference numeral 1 (FIG. 1) generally designates a hydraulically actuated exhaust gas recirculation ("EGR") valve for metering exhaust gas flow to the intake of an internal combustion engine. In the illustrated example, EGR valve 1 includes a base 2 having an internal cavity 3 (FIG. 2) having a control portion 4 and a flow-through portion 5 permitting flow-through of exhaust gas 6 (FIG. 5). The base 2 has at least one hydraulic control port 7 (FIG. 4) in fluid communication with the control portion 4 of the cavity 3. The hydraulic control port 7 has an inlet 9. A valve body 11 (FIG. 2) is rotationally mounted within the base 2. Valve body 11 has a hydraulic control spool 12 disposed within the control portion 4 of the internal cavity 3. The hydraulic control spool 12 generates a rotational force F1 (FIG. 4) in response to a hydraulic pressure applied to the control port 7. The valve body 11 also includes an exhaust gas control spool 13 (FIG. 5) positioned in the flow-through portion 5 of the internal cavity 3 and connected to the hydraulic control spool 12 and rotating therewith to selectively control flow of exhaust gas 6 through the flow-through portion of the internal cavity 3.

With reference to FIG. 1, the hydraulically actuated EGR valve of the present invention may be secured to an internal combustion engine 14 by conventional threaded fasteners 15. Exhaust gas is supplied through an inlet line 17 that is connected to exhaust gas inlet port 26, and the exhaust gas exits through exhaust gas outlet port 27 and outlet line 18. The base 2 may also be configured to connect exhaust gas inlet and outlet ports 26 and 27 with exhaust gas passageways (not shown) in the engine intake manifold or other engine component according to known EGR valve exhaust gas routing arrangements. A hydraulic line 16 supplies pressurized hydraulic fluid, such as engine oil, to hydraulic inlet port 50.

A first embodiment 20 of the hydraulically actuated EGR valve of the present invention is illustrated in FIGS. 2–5. EGR valve assembly 20 includes a first hydraulic control port 7, and a second hydraulic control port 8 forming a second hydraulic inlet 10. A first embodiment of the hydraulic control spool 12 (FIG. 4) includes a first cavity 21 in fluid communication with the first hydraulic control port 7, and a second cavity 22 in fluid communication with the second hydraulic control port 8. The first and second cavities 21 and 22 each define a first surface 22 and a second, smoothly curved surface 24. Cavities 21 and 22 of spool 12 form sidewalls 36 and 37 (FIG. 2) having edges 34 and 35 that contact the sidewall 33 of cavity 3 to seal the hydraulic fluid in cavities 21 and 22 and prevent the hydraulic fluid from entering the flow-through portion 5 of internal cavity 3. During operation, pressurized hydraulic fluid or oil is introduced selectively into the first or second hydraulic control ports 7 and 8. The hydraulic pressure acts against one of the first surfaces 23 to selectively rotate the hydraulic control spool 12 in first or second rotational directions. For example, introduction of hydraulic pressure through hydraulic control port 7 will result in rotation of the hydraulic control spool 12 in a clockwise direction. Conversely, introduction of hydraulic pressure into the second hydraulic control port 8 will cause the hydraulic control spool 12 to rotate in a counter-clockwise direction. This arrangement provides "bi-directional" hydraulic control of exhaust gas control spool 13, such that spool 13 can be selectively opened or closed upon application of hydraulic pressure to ports 7 and/or 8. A square shaft 25 rigidly interconnects the hydraulic control spool 12 in the exhaust gas control spool 13 (FIG. 5). An exhaust gas inlet 26 and exhaust gas outlet port 27 are in fluid communication with the flow-through portion 5 of internal cavity 3.

Exhaust gas control spool 13 includes a cavity 28 defined by a curved surface 29. Curved surface 29 is relatively shallow and narrow at a first end 30 with a relatively small cross-sectional area (see also FIG. 2), and tapers to a wider and deeper portion adjacent the second end 31 having a relatively large cross-sectional area. The gradually increasing cross-sectional area of the cavity 28 permits an increasing amount of exhaust gas 6 to flow from inlet 26 to outlet 27 as the exhaust gas control spool 13 is rotated in a counter-clockwise direction from the position illustrated in FIG. 5.

Hydraulic control spool 12 and the exhaust gas control spool 13 each include three sharp knife edges 32 that slide along the cylindrical sidewall 33 of internal cavity 3 when spools 12 and 13 are rotated. The sharp edges 32 clear away carbon or other material from the exhaust gas 6 that would otherwise become deposited on the sidewall 33. Significantly, hydraulic control spool 12 generates a substantial force that may be much greater than a conventional electrical solenoid type EGR valve, such that carbon or other deposits can be scraped away while maintaining proper functioning of the EGR valve of the present invention. The combination of the sharp edges 32 that scrape away exhaust deposits and the high-force hydraulic control provides improved control of recirculating exhaust gas by keeping the valve control performance from degrading over time due to an increase in friction that would otherwise be caused by the deposits. Accordingly, proper metering of exhaust gas flow through the EGR valve is maintained, such that emission requirements can be met. Also, the large force generated by the hydraulic control spool 12 is advantageous in diesel applications wherein a high backpressure is developed by the diesel engine. Sharp edges 32 can be configured to fit closely against the cylindrical sidewall 33 of cavity 3, such that the edges 32 act as seals to prevent flow of hydraulic fluid or exhaust gas around the edges 32.

Figure 2:
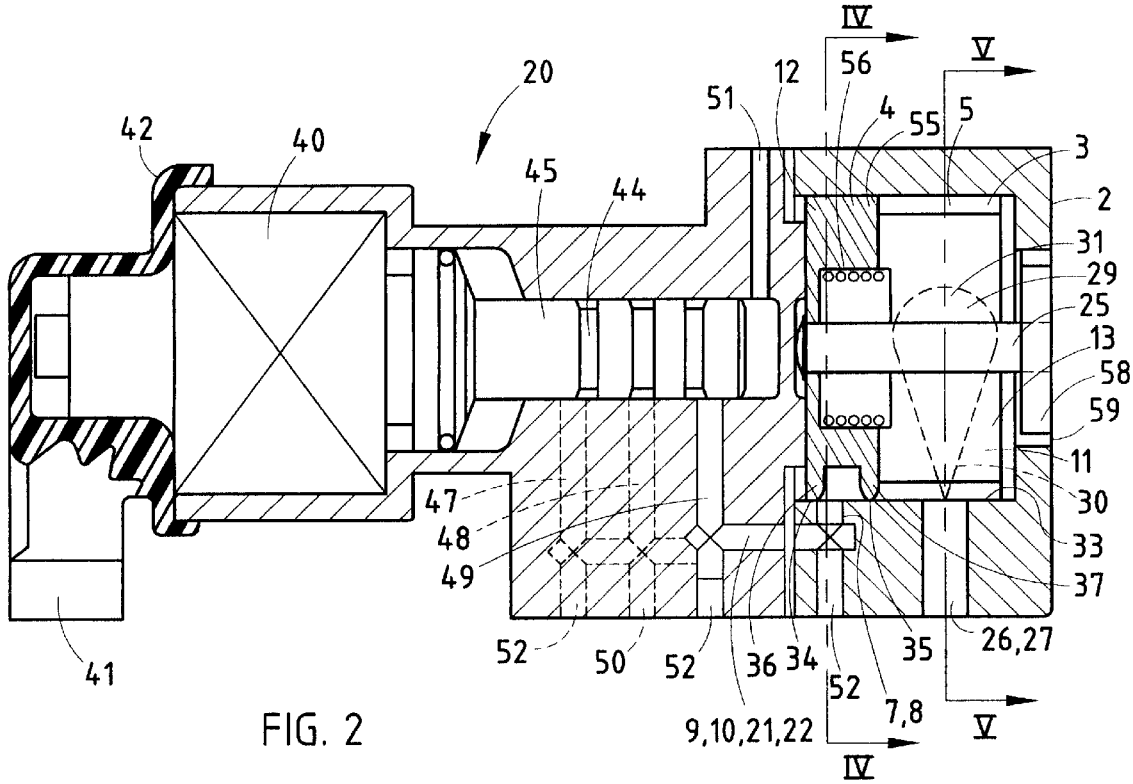
FIG. 2 is a cross-sectional view of a first embodiment of the hydraulically controlled EGR valve of FIG. 1 wherein the valve body is hydraulically powered in first and second rotational directions.

With reference to FIG. 2, an electrical solenoid 40 is connected to a conventional four-way control valve 45. Four-way control valve 45 includes a plurality of passageways 44 that may be selectively aligned with hydraulic control ports 47, 48, and 49, such that pressurized hydraulic fluid entering at hydraulic inlet 50 is selectively routed to the first hydraulic control port 7, the second hydraulic control port 8, or to the hydraulic return port 51. The hydraulic passageways are formed by drilling the base 2, and plugs 52 are then installed to block off the passages to provide the appropriate internal routing of the hydraulic fluid. Plugs 52 may be welded, threaded, or otherwise secured as required. A cap 42 provides an electrical connection 41 to electrically connect the solenoid 40 to the electrical control module (ECM) to provide electronic control of the EGR valve.

A coil spring 55 (FIG. 2) fits within a cylindrical cavity 56 in hydraulic control spool 12. A first end (not shown) of coil spring 55 is secured to the base 2, and a second end (not shown) of coil spring 55 is secured to the hydraulic control spool 12. The coil spring 55 biases the hydraulic control spool 12 into the center position illustrated in FIG. 4, with the exhaust gas control spool 13 in the "off" position illustrated in FIG. 5, wherein exhaust gas 6 cannot flow through the exhaust gas ports 26 and 27. A mechanical stop 57 (FIG. 5) prevents rotation of the spools 12 and 13 in a counter-clockwise direction beyond the position illustrated in FIGS. 4 and 5. Coil spring 55 biases the edge 32 into the mechanical stop 57, thereby ensuring that the exhaust gas control spool 13 returns to the closed position in the event there is a loss of hydraulic pressure to the control ports 7 and 8 due to a failure of a component in the system. A bearing plate 58 (FIG. 2) is secured to the square shaft 25, and rotatably supports the spools 12 and 13, and also closes off the lower opening 59 in base 2 to prevent escape of exhaust gas from the flow-through portion 5 of internal cavity 3. Hydraulic control spool 12 and exhaust gas control spool 13 are press-fit or otherwise securely fixed to the square shaft 25. Spools 12 and 13 are made of stainless steel, or other like material providing sufficient hardness to scrape exhaust deposits from the sidewalls 33, while also resisting corrosive degradation. The pressurized hydraulic fluid for control of EGR valve 1 may be supplied from the engine lubrication system, a power steering pump, or an automatic transmission. Alternately, a separate hydraulic pump could be utilised if required for a particular application.

A second embodiment of the hydraulically controlled EGR valve of the present invention as illustrated in FIGS. 6–9. The second embodiment 60 of the hydraulically actuated EGR valve of the present invention is similar to the "bi-directional" EGR valve 20 illustrated in FIGS. 3–5, except that EGR valve 60 is a "unidirectional" hydraulic control arrangement wherein hydraulic pressure acting on hydraulic control spool 63 rotates the hydraulic control spool 63 in a counter-clockwise direction, and a coil spring 65 returns the spools 12 and 63 to the closed position (FIGS. 8 and 9) upon release of hydraulic pressure on hydraulic control port 64. The second embodiment of the base 62 has an internal cavity 3 that is substantially the same as that described above for base 2. The second embodiment 60 of the EGR valve includes an exhaust gas control spool 13 including a flow-through cavity 28 and sharp edges 32 that is substantially identical to the exhaust gas control spool 13 described above with respect to the first embodiment of the hydraulic EGR valve of the present invention. Exhaust gas control spool 13 is mounted in flow-through portion 5 of internal cavity 3, and selectively meters the flow of exhaust gas through the exhaust inlet and outlet ports 26 and 27.

A second embodiment 63 of the hydraulic control spool includes a single cavity 66 in fluid communication with a single hydraulic control port 64. Cavity 66 is formed by first and second surfaces 67 and 68 on spool 63. Upon introduction of hydraulic pressure in port 64, a force is generated on the surface 67, causing rotation of spools 13 and 63 in a counter-clockwise direction when viewed in the orientation of FIGS. 8 and 9.

An electrical solenoid 40 (FIG. 6) operates a hydraulic control valve 72. Hydraulic control valve 72 can be shifted to selectively control the flow of pressurized hydraulic fluid from inlet 70 to hydraulic control port 64, or to hydraulic return port 71. A coil spring 65 biases the spools 13 and 63 to the closed position illustrated in FIGS. 8 and 9, wherein a sharpened edge 32 contacts a mechanical stop 57 (FIG. 8) to prevent further rotation of the spools. Coil spring 65 is similar to the coil spring 55 described above, except that coil spring 65 is substantially stiffer that spring 55 to generate a larger moment for rapid return of the spools 13 and 63 to the closed position upon release of hydraulic pressure on hydraulic control port 64.

Figure 3:
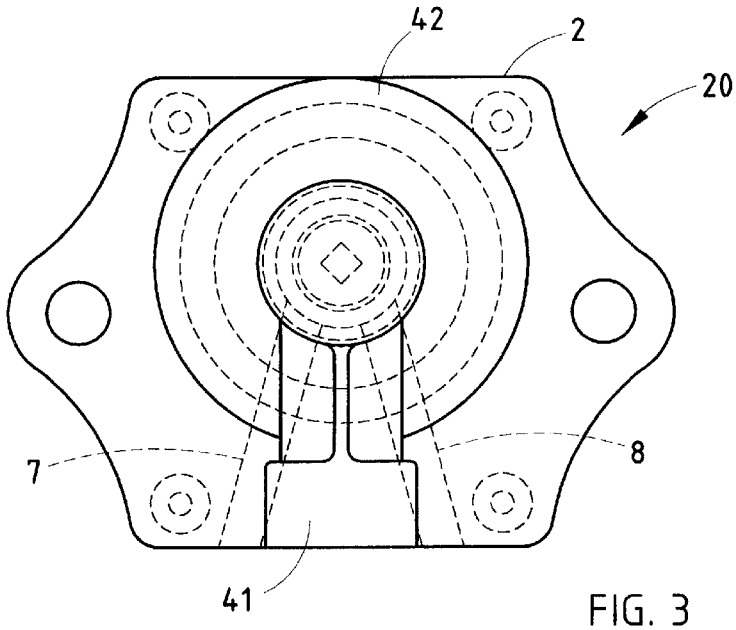
FIG. 3 is a side elevational view of the EGR valve of FIG. 2.

In operation, the EGR valves 20 and 60 open in impulses to provide a duty cycle. The electronic control module (ECM) of the engine provides a PWM signal that drives the electrical solenoid 40, thus controlling the EGR valve. The PWM signal provides a continuously variable output from 0–100%. A closed loop control algorithm in the ECM determines the output duty cycle to the EGR valve. The "bi-directional" embodiment 20 of FIGS. 3–5 is opened by applying hydraulic pressure to the second hydraulic control port 8, and the valve is rotated to the closed position by applying hydraulic pressure to the first control port 7 while releasing hydraulic pressure from control port 8. The bi-directional EGR valve 20 can thus be opened and closed under hydraulic pressure to provide very rapid opening and closing of the EGR valve if required for a particular duty cycle. The unidirectional second embodiment 60 of the EGR valve is opened by application of hydraulic pressure to the hydraulic control port 64 during the duty cycle. However, unlike the bi-directional EGR valve 20, the unidirectional EGR valve 60 is closed by releasing pressure in hydraulic control port 64, such that coil spring 65 returns the valve to the closed position illustrated in FIGS. 8 and 9. The spring rate ("stiffness") of spring 65 is selected based upon the duty cycle requirements and the dynamic characteristics of the rotating valve components to provide proper valve closure during operation.

The hydraulically controlled EGR valve of the present invention generates a large rotational force, such that build up of carbon or other exhaust deposits in EGR valve does not result in degradation of the performance of the EGR valve. Further, the sharp scraping edges of the hydraulic control spool and the exhaust gas control spool scrape carbon and like deposits from the walls of the internal cavity, such that the EGR valve has a self-cleaning operation.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. A hydraulically actuated exhaust gas recirculation valve assembly for metering exhaust gas flow to the intake of an internal combustion engine, said valve assembly comprising:

a base having an internal cavity with a control portion and a flow-through portion permitting flow-through of exhaust gas, said base having at least one hydraulic control port in fluid communication with said control portion of said internal cavity, said control port having an inlet; and a valve body rotationally mounted within said base, said valve body having a hydraulic control spool disposed within said control portion of said internal cavity, said hydraulic control spool generating a rotational force in response to a hydraulic pressure applied to said control port; said valve body further including an exhaust gas control spool positioned in said flow-through portion of said internal cavity and connected to said hydraulic control spool and rotating therewith to selectively control flow of exhaust gas through said flow-through portion of said internal cavity.

2. The valve assembly set forth in claim 1, wherein:

said control portion of said internal cavity includes a cylindrical internal sidewall surface; and said exhaust gas control spool includes at least one sharpened edge in close proximity to said internal sidewall surface to remove deposits from said internal sidewall surface upon rotation of said valve body.

3. The valve assembly set forth in claim 2, wherein:

said exhaust gas control spool defines an axis of rotation and includes at least three sharpened edges evenly spaced at about one hundred and twenty degree locations relative to one another about said axis of rotation, each sharpened edge in close proximity to said cylindrical sidewall surface to remove deposits upon rotation of said valve body.

4. The valve assembly set forth in claim 1, wherein:

said exhaust gas control spool has a closed position preventing flow of exhaust gas through said base; and including:

a resilient member biasing said exhaust gas control spool to said closed position, and wherein said rotational force is sufficient to overcome the bias of said resilient member.

5. The valve assembly set forth in claim 1, wherein:

said hydraulic control spool and said exhaust control spool are rigidly interconnected.

6. The valve assembly set forth in claim 1, wherein:

said control port comprises a first control port, said base further including a second control port in fluid communication with said control portion of said internal cavity;

said exhaust gas control spool having a first control surface in fluid communication with said first control port, and a second control surface in fluid communication with said second control port, such that said control spool generates a rotational force when a pressure differential exists between said first and second control ports.

7. The valve assembly set forth in claim 6, wherein:

said base includes first and second exhaust gas ports in fluid communication with said flow-through portion of said internal cavity;

said exhaust gas control spool has a generally cylindrical outer surface portion positionable in fluid communication with said first and second exhaust gas ports, said outer surface defining a tapered depression that permits flow of exhaust gas from said first exhaust gas port to said second exhaust gas port through said tapered depression.

8. The valve assembly set forth in claim 7, wherein:

said tapered depression has a cross-sectional area that varies such that the exhaust gas flow through said exhaust gas ports can be varied upon rotation of said exhaust gas control spool.

9. The valve assembly set forth in claim 6, including:

an electrically powered actuator; and a four-way hydraulic control valve having an inlet port, a return port, and first and second outlet ports in fluid communication with said first and second control ports, said four-way hydraulic control valve operably connected to said electrically powered actuator and selectively controlling the hydraulic pressure supplied to said first and second control ports upon actuation of said electrically powered actuator.

10. An internal combustion engine including a hydraulically actuated valve assembly for metering exhaust gas to the intake of said internal combustion engine, said valve assembly comprising:

a housing having an exhaust gas inlet port operably connected to the exhaust of said internal combustion engine, and an exhaust gas outlet port operably connected to the intake of said internal combustion engine;

a valve body rotatably mounted within said housing and selectively metering the flow of exhaust gas between said exhaust gas inlet port and said exhaust gas outlet port upon rotation of said valve body within said housing, said valve body operably connected to a source of pressurized hydraulic fluid and configured to move for metering of exhaust gas flow upon application of hydraulic pressure to said valve body.

11. The internal combustion engine set forth in claim 10, wherein:

said valve body defines a closed position preventing flow of exhaust gas between said exhaust gas inlet and outlet ports; and a resilient member biasing said valve body into said closed position.

12. The internal combustion engine set forth in claim 11, wherein:

said housing includes first and second hydraulic control ports, said valve body configured to rotate when a pressure difference exists between said first and second hydraulic control ports.

13. The internal combustion engine set forth in claim 10, wherein:

said housing includes an internal cavity in fluid communication with said exhaust gas inlet and outlet ports, said internal cavity having a curved inner surface; and said valve body rotatably mounted within said housing and including a sharpened edge in close proximity to said curved inner surface to remove deposits from said curved inner surface upon rotation of said valve body.

14. The internal combustion engine set forth in claim 10, wherein:

said housing includes an internal cavity having first and second hydraulic ports in fluid communication with said internal cavity;

said valve body rotatably mounted within said housing and including a first control surface in hydraulic communication with said first hydraulic inlet port, and a second control surface in hydraulic communication with said second hydraulic inlet port, such that said valve body is selectively rotated to meter exhaust gas upon application of a pressure difference between said first and second hydraulic inlet ports.

15. The internal combustion engine set forth in claim 14, wherein:

an electrically controlled powered actuator; and a four-way hydraulic control valve operably connected with said powered actuator and selectively controlling the hydraulic pressure supplied to said first and second hydraulic inlet ports.

16. The internal combustion engine set forth in claim 15, wherein:

said internal combustion engine includes a lubrication system having an oil pump that pressurizes oil; and a four-way hydraulic control valve is operably connected with said oil pump such that the pressurized oil is selectively supplied to said first and second hydraulic inlet ports by said four-way hydraulic control valve.

17. A hydraulically actuated exhaust gas recirculation valve assembly for metering exhaust gas to the intake of an internal combustion engine, said valve assembly comprising:

a housing having an internal cavity defining a generally cylindrical sidewall surface and having an exhaust gas inlet port in fluid communication with said internal cavity and adapted to be connected to the exhaust of an internal combustion engine, said housing further including an exhaust gas outlet port in fluid communication with said internal cavity and adapted to be connected to the intake of an internal combustion engine; and a valve body rotatably mounted within said internal cavity and selectively metering exhaust gas flow through said housing, said valve body including a sharpened knife edge disposed adjacent said sidewall surface such that said knife edge removes exhaust gas deposits from said sidewall surface upon rotation of said valve body.

18. The exhaust gas recirculation valve set forth in claim 17, wherein:

said housing has at least one hydraulic fluid inlet port in fluid communication with said valve body for powered rotation of said valve body.

19. The exhaust gas recirculation valve set forth in claim 18, wherein:

said valve body is movable to a closed position wherein valve body prevents flow of exhaust gas through said exhaust gas recirculation valve, and including:

a resilient member biasing said valve body into said closed position.

20. The exhaust gas recirculation valve set forth in claim 17, wherein:

said housing includes first and second hydraulic inlet ports configured to rotate said valve body when a pressure differential exists between said first and second hydraulic inlet ports.

21. The exhaust gas recirculation valve set forth in claim 20, wherein:

an electrically controlled powered actuator; and a four-way hydraulic control valve operably connected with said powered actuator and selectively controlling the hydraulic pressure supplied to said first and second hydraulic inlet ports.

22. The exhaust gas recirculation valve set forth in claim 21, wherein:

said internal combustion engine includes a lubrication system having an oil pump that pressurizes oil; and a four-way hydraulic control valve operably connected with said oil pump such that the pressurized oil is selectively supplied to said first and second hydraulic inlet ports.

23. The exhaust gas recirculation valve set forth in claim 17, wherein:

said valve body includes an outer surface defining an elongated tapered depression that permits a variable flow of exhaust gas through said tapered depression depending upon the angular position of said valve body relative to said exhaust gas inlet and outlet ports.

* * * * *